United States Patent [19]

Falarde

[11] 4,109,836

[45] Aug. 29, 1978

[54] SELF-SEALING PASTE DISPENSING DEVICE

[76] Inventor: Anna Falarde, 56 Malvern St., Providence, R.I. 02904

[21] Appl. No.: 767,359

[22] Filed: Feb. 10, 1977

[51] Int. Cl.[2] ..... B65D 25/42

[52] U.S. Cl. ..... 222/494; 239/533.13; 137/849

[58] Field of Search ..... 222/575, 494; 239/533.13; 137/846, 849

[56] References Cited

U.S. PATENT DOCUMENTS

| | | | |
|---|---|---|---|
| 2,743,852 | 5/1956 | Alberdi, Jr. | 222/494 |
| 2,755,974 | 7/1956 | Godfrey | 222/494 |
| 3,118,468 | 1/1964 | Bochan | 137/846 |
| 3,285,256 | 11/1966 | Despard | 222/575 X |

FOREIGN PATENT DOCUMENTS

| | | | |
|---|---|---|---|
| 482,369 | 6/1953 | Italy | 222/494 |

*Primary Examiner*—Joseph F. Peters, Jr.
*Assistant Examiner*—Norman L. Stack, Jr.
*Attorney, Agent, or Firm*—Barlow & Barlow

[57] ABSTRACT

A self-sealing paste discharge device for dispensing semi-liquid substances especially such as are contained in a collapsible tube in which there is an elastic neck having an elastic closure slitted, the neck presenting a helical path to the slitted closure end so that when paste under pressure is forced through the helical path of the neck, pressure on the opposite sides of the path will open the slit or slits in the closure for the discharge of the paste therethrough, the relationship of the relative elasticity of the neck and closure to the viscosity of the paste being such that when the pressure on the paste is released, the parts on either side of the slit will come together and seal the discharge path.

4 Claims, 8 Drawing Figures

SELF-SEALING PASTE DISPENSING DEVICE

BACKGROUND OF THE INVENTION

Various forms of self-sealing tubes have been heretofore utilized in which there has been some elasticity of the discharge neck from the tube in which the tube is closed by contracting against a post or ball, such as seen in Pat. No. 2,107,106, or the closure may open or close by pinching together the opposite sides of a slit closure portion such as in U.S. Pat. No. 3,773,233 where the pressure is by means of the resilient walls at the end of the slitted closure.

SUMMARY OF THE INVENTION

In the particular structure here described, there is a neck portion formed of some plastic material with a closure end which end is provided with slits either in an end wall or by reason of the side walls coming together, and from this closure a neck of an elastic material extends in an internal helical path such as might be thought of as a screw thread, the arrangement being such that when paste is forced through this helical path, it exerts pressure on opposite walls of the path so as to separate either side of the material which forms the slitted end, thus permitting the paste to discharge through this slitted closure, the stiffness or durometer of the neck and closure end being of such elasticity relative to the viscosity of the paste which passes therethrough as to contract the portions on opposite sides of the slit to close the discharge end when the pressure on the paste as it is forced through the helical path is released.

DESCRIPTION OF THE PREFERRED EMBODIMENT

Figure 1:
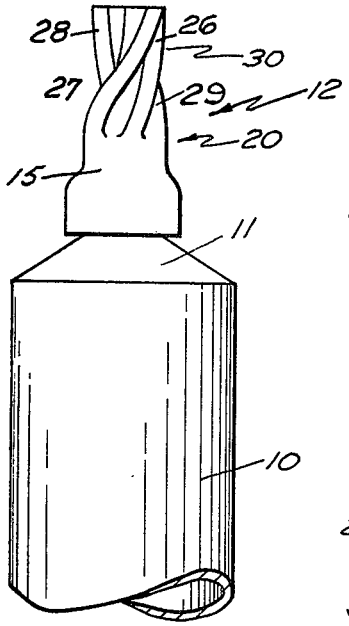
FIG. 1 is an elevation of a collapsible tube equipped with the discharge device of this invention.
Figure 3:
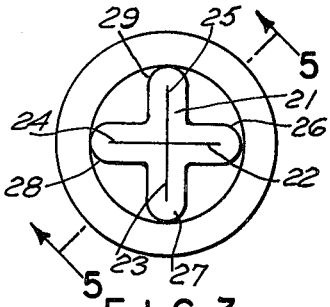
FIG. 3 is an end view of the discharge device in closed position.
Figure 2:
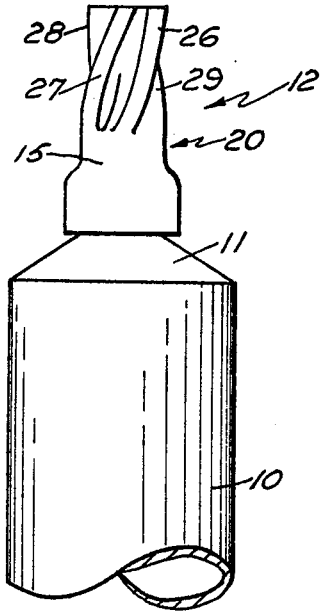
FIG. 2 is a similar view in which the discharge device is rotated through 90°.
Figure 5:
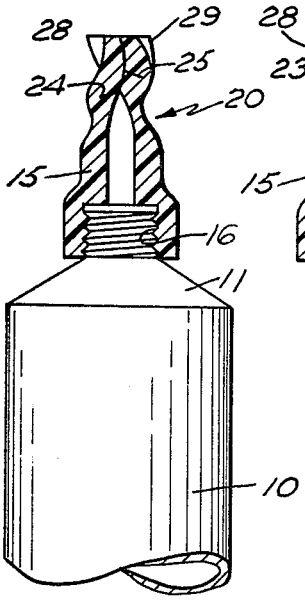
FIG. 5 is a section of line 5—5 of FIG. 3.

Referring to FIG. 1, 10 designates a fragmental portion of a collapsible tube which is equipped at its discharge end 11 with the device 12 of this invention. The device, as shown in FIG. 5, comprises a body portion 15 which in this instance is threadably secured on the relatively stiff threaded neck portion 16 that forms a discharge orifice of the collapsible tube 10 which might contain toothpaste. The body 15 has a neck generally indicated 20 extending therefrom with a closure wall 21 (FIG. 3) at its discharge end which may exist either as a lateral extending wall or as the end wall of a plurality of pairs of walls helicoidally arranged to provide helical paths and coming together at their ends so as to provide radiating slits 22, 23, 24 and 25 from a generally center point. From these radiating slits, in this instance four (in FIG. 3), there extends internal helical paths formed by pairs of walls 26, 27, 28, 29 which are shown externally in FIGS. 1 and 2 to provide an external helical configuration generally designated 30, there being one U-shaped wall forming a path to each exit slit 22, 23, 24, 25.

Figure 4:
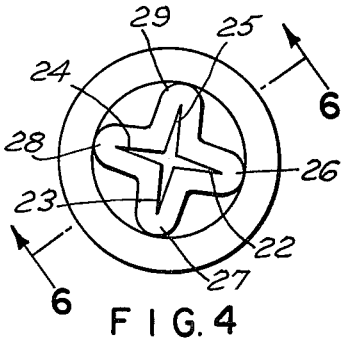
FIG. 4 is a similar end view in which the slits are separated for discharge.
Figure 6:
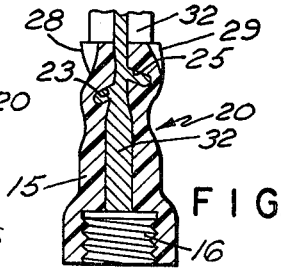
FIG. 6 is a section line 6—6 of FIG. 4 showing the paste as passing through the discharge end.

The material of the neck 20 may be polyethylene or polypropylene, or other plastic material which will have a stiffness or durometer and elasticity so proportioned to the viscosity of the paste which it is to dispense that it will close upon the paste when no pressure on the paste is present but such that when the paste is forced by pressure on the collapsible tube up to the neck, it will press on the opposite internal walls of the paths to each of the slits so as to move the walls defining the path apart and open the slits such as shown in FIG. 4 and thus permit the paste to pass through the slits as is shown in FIG. 6 where the paste is designated 32. Upon release of the pressure on the paste, as by releasing pressure on the collapsible tube 10, the pressure will be released on the sides of the paths to the slits so that the slits will move from open position as shown in FIG. 4 to the closed position shown in FIG. 3 and thus seal the neck. The helical path to each of the slits will be about a quarter of a helical turn to about half a helical turn.

Figure 7:
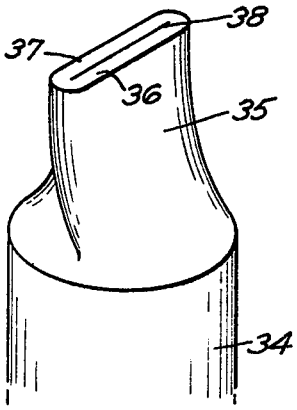
FIG. 7 is a perspective view of the end portion of a tube with a modified discharge device.
Figure 8:
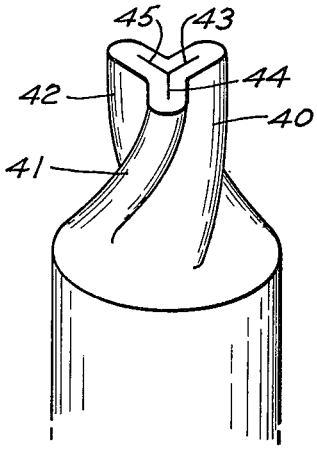
FIG. 8 is a perspective view of the end portion of a tube with a still different modified discharge device.

In FIG. 7 I have shown a more simplified form of neck 35 formed as one piece with the collapsible tube 34 which neck has a quarter turn and the elongated neck has side walls 36 and 37 which come together to form the slit 38. In FIG. 8 there are shown three helical paths formed by pairs of walls 40, 41 and 42 in which the side walls of each of the paths come together to form slits 43, 44 and 45, the helical paths in each instance being approximately a quarter of a turn.

By the arrangement above described the pressure is applied to the collapsible tube such as 10 or 34 so that it operates substantially as the usual toothpaste tube which has a completely open end with a cap to close it, only in this case there is no need to remove the cap as the helical paths open the collapsible tube when the pressure is applied to the collapsible tube and upon release of this pressure the closure returns to sealing position by its own elasticity, thus making it unnecessary to provide a removable cap which has to be removed and may be lost.

I claim:

1. A self-sealing paste discharge device comprising a body portion with a neck extending therefrom, said neck having sufficient elasticity for tortional movement under pressure and a closed end with a laterally extending slit to permit the portions on either side of the slit to separate, said neck extending from said closed end presenting a portion of an internal helical path along its longitudinal axis so that as paste is forced through the path there will be a pressure brought to bear on the sides of the path to turn the neck a portion of a revolution about its axis to separate the sides of the path and spread the portion of the closure end on either side of said slit to permit discharge of the paste therethrough, the elasticity of the neck bringing the portions on either side of the slit together when the pressure of the paste is released.

2. A paste discharge device as in claim 1 wherein said helical path extends at least about a quarter of a revolution.

3. A paste discharge device as in claim 1 wherein there are a plurality of radial slits in said closed end a like number of internal helical paths extending to said slits.

4. A dispensing tube comprising a hollow collapsible tube having walls with tortional resilience, a discharge orifice, a closure member about the orifice comprising at least a pair of resilient walls defining a path therebetween said path terminating in a slit, said walls lying on a helicoid whereby the path therebetween is helical and pressure on the resilient wall will turn the walls a portion of a revolution about the axis of the helicoid to open said slit.

* * * * *